US010182955B2

(12) United States Patent
Brulotte et al.

(10) Patent No.: US 10,182,955 B2
(45) Date of Patent: Jan. 22, 2019

(54) CONFIGURABLE PATIENT CEILING LIFT

(71) Applicant: ArjoHuntleigh Magog Inc., Magog (CA)

(72) Inventors: Denis-Alexandre Brulotte, Orford (CA); Martin Faucher, Magog (CA); Joel Bossé, Sherbrooke (CA)

(73) Assignee: ArjoHuntleigh Magog Inc. (CA)

( * ) Notice: Subject to any disclaimer, the term of this patent is extended or adjusted under 35 U.S.C. 154(b) by 0 days.

(21) Appl. No.: 15/527,636

(22) PCT Filed: Nov. 17, 2015

(86) PCT No.: PCT/CA2015/051197

§ 371 (c)(1),
(2) Date: May 17, 2017

(87) PCT Pub. No.: WO2016/077920

PCT Pub. Date: May 26, 2016

(65) Prior Publication Data

US 2017/0360635 A1 Dec. 21, 2017

Related U.S. Application Data

(60) Provisional application No. 62/080,894, filed on Nov. 17, 2014.

(51) Int. Cl.
*A61G 7/10* (2006.01)
*A61G 7/14* (2006.01)

(52) U.S. Cl.
CPC ..... *A61G 7/1015* (2013.01); *A61G 7/1042* (2013.01); *A61G 7/1051* (2013.01); (Continued)

(58) Field of Classification Search
CPC .. A61G 7/1015; A61G 7/1042; A61G 7/1051; A61G 7/1065; A61G 2203/32; A61G 2203/44
See application file for complete search history.

(56) References Cited

U.S. PATENT DOCUMENTS 4,627,119 A 12/1986 Hachey et al.
4,639,955 A 2/1987 Carminati et al.
(Continued)

FOREIGN PATENT DOCUMENTS

EP 2764857 A2 8/2014

*Primary Examiner* — Robert G Santos
*Assistant Examiner* — Rahib T Zaman
(74) *Attorney, Agent, or Firm* — The Webb Law Firm

(57) ABSTRACT

A ceiling lift assembly includes first and second motor units which can be operated together in a dual mode configuration and which can be operated in a single mode operation, in which only one of the motor units is operative with the other motor unit being dormant. The system provides routines for switching between the single and dual modes of the assembly and which ensure that in each mode the necessary parts of the apparatus are in an operative condition, whereas those parts of the apparatus which are not used are placed in a storage condition to avoid inconvenience or injury to personnel and patients. The apparatus also includes a motor unit support device of a structure which can accommodate asymmetric loads, on one motor unit only without causing deformation of the support structure.

17 Claims, 11 Drawing Sheets

(52) U.S. Cl.
CPC ..... *A61G 7/1061* (2013.01); *A61G 7/1065* (2013.01); *A61G 2200/16* (2013.01); *A61G 2203/12* (2013.01); *A61G 2203/20* (2013.01); *A61G 2203/32* (2013.01); *A61G 2203/44* (2013.01)

(56) References Cited

U.S. PATENT DOCUMENTS

| | | | | |
|---|---|---|---|---|
| 6,006,377 | A | 12/1999 | Asakawa | |
| 6,085,368 | A * | 7/2000 | Robert | A61G 7/1015 5/83.1 |
| 8,740,492 | B2 | 6/2014 | Andreasen | |
| 2003/0200607 | A1* | 10/2003 | Faucher | A61G 7/1015 5/81.1 R |
| 2003/0201374 | A1* | 10/2003 | Faucher | F16B 5/0685 248/343 |
| 2004/0239060 | A1* | 12/2004 | Faucher | A61G 7/05 280/47.11 |
| 2011/0000015 | A1* | 1/2011 | Faucher | A61G 7/1042 5/83.1 |
| 2011/0239367 | A1 | 10/2011 | Gramkow et al. | |
| 2012/0317715 | A1* | 12/2012 | Corriveau | A61G 7/1017 5/86.1 |
| 2013/0019401 | A1* | 1/2013 | Faucher | A61G 7/1015 5/85.1 |
| 2013/0038263 | A1 | 2/2013 | Faucher et al. | |
| 2013/0086793 | A1* | 4/2013 | Faucher | F16B 19/00 29/525.01 |
| 2014/0143952 | A1* | 5/2014 | Trepanier | A61G 7/1015 5/83.1 |
| 2014/0201906 | A1 | 7/2014 | Erturk et al. | |
| 2014/0223660 | A1 | 8/2014 | Bolin | |

* cited by examiner

CONFIGURABLE PATIENT CEILING LIFT

CROSS-REFERENCE TO RELATED APPLICATIONS

This application is the United States national phase of International Application No. PCT/CA2015/051197 filed Nov. 17, 2015, and claims priority to U.S. Provisional Patent Application No. 62/080,894 filed Nov. 17, 2014, the disclosures of which are hereby incorporated in their entirety by reference.

TECHNICAL FIELD OF THE DISCLOSURE

The present disclosure relates to a configurable patient ceiling lift for use, for example, in a hospital or care home.

BACKGROUND OF THE DISCLOSURE

Ceiling lifts for lifting and transporting patients have been in use for over twenty years. These types of patient lift are becoming more popular as they take up little space in a hospital or care home environment and are more efficient than floor lifts.

A ceiling lift can be described as a motor unit able to move along one or more rails arranged as a rail system, fixed to the ceiling. A flexible member such as a strap extends from the motor unit and is attached to a spreader bar. A patient sling or harness is attached to the spreader bar. An electrically motorized mechanism in the motor unit allows the user to extend or shorten the strap so as to raise or lower the spreader bar and with this to raise or lower the sling and any patient carried in the sling. The combination of rail system, motor unit, spreader bar and sling is often referred to as a ceiling lift system.

Some ceiling lift systems are said to be fixed (the motor unit is dedicated to one room) while others are said to be portable (the motor unit can move around from room to room).

Over the last decades the size (weight & morphology) of patients has increased, causing manufacturers of ceiling lift systems to develop solutions which better address the handling challenges which larger patients pose. The initial response from manufacturers was to increase the lifting capacity of their existing products. Since then, patient handling techniques were developed, industry standards were established and user (patient and care givers) needs were better understood. It appears that there was room for devices which could do more than just having a greater lifting capacity and be able to transfer a patient in a fixed seated position. Indeed, users were in the need of a product with greater versatility.

One design adopted by manufacturers for handling patients of very large size (with a Body Mass Index above 40 or of weight above 160 kg, for example) has two motor units with two spreader bars which operate together. In one configuration, one of the motor units and its associated spreader bar supports/lifts the shoulder section of the patient, while the other motor unit and spreader bar supports/lifts the patient's leg section. A key benefit of such solution is the ability to provide a tilting function to sit or recline the patient during transfer, by creating a height difference between the spreader bars. Bringing the leg section spreader bar above the shoulder section spreader bar leads to a patient reclined position, while bringing the leg section spreader bar below the shoulder section spreader bar leads to a patient sitting position.

A tilting function can increase patient comfort and reduce caregiver effort to transfer a patient. Although the above-described solutions for very large patients can provide significant benefits, they can sometimes have the drawback of being suitable only to such patient morphology. Care institutions face the challenge of making the care environment, typically the patient rooms, as versatile as possible when it comes to the range of patients they can handle. As a result the patient environment should be able to accommodate very large patients but also very small patients. Otherwise, a room dedicated for very large sized patients can often be unoccupied for long periods of time.

As described below, some solutions have been proposed but these have limitations.

SUMMARY OF THE DISCLOSURE

The present disclosure seeks to provide an improved patient ceiling lift system and more specifically relates to a configurable patient ceiling lift.

According to an aspect of the present disclosure, there is provided a configurable patient ceiling lift system, including: first and second motor units; first and second flexible strap elements each coupled to a respective one of the first and second motor units, each motor unit being operable to change an operative length of its associated strap element by extending or retracting the strap out of or into the motor unit, each strap element including a coupling for attachment to a patient sling; a control unit coupled to the first and second motor units and configured to operate the motor units in a dual mode or a single mode, wherein in the dual mode the motor units are both operable and in the single mode the first motor unit is operable and the second motor unit does not operate.

According to another aspect of the present disclosure there is provided a configurable patient ceiling lift system, including: first and second motor units; first and second tensile support members operatively associated with a winding assembly to adjust an operative length of the tensile support members by extending or retracting the tensile support member, each tensile support member including a coupling for attachment to a patient sling; a control unit coupled to the first and second motor units and configured to operate the motor units in a dual mode or a single mode, wherein in the dual mode the motor units are both operable and in the single mode the first motor unit is operable and the second motor unit does not operate.

In practice, in the dual mode a double patient spreader bar assembly can be attached to the strap elements of and operated by the first and second motor units, while in the single mode a single spreader bar can be attached to the strap element of and operated by the first motor unit.

The motor units may be separate devices with separate casings and components, linked electrically for coordinated control, as well as being individually controllable. It is not excluded, though, that the motor units could be incorporated into a common device with a common casing. In such cases, the motors of each motor unit remain both independently controllable and controllable in coordinated manner. The link between the motor units may be a direct link or an indirect link, for instance through a controller. In another embodiment a single motor through a geared system could provide motion to a pair of strap simultaneously or to only one of the strap.

The configurable ceiling lift system is suited to accommodate patients of a large variety of sizes and weights, thereby making the system more useful in a care home or hospital environment.

Advantageously, in an embodiment, the second motor unit is disabled in the single mode. Thus, the second motor unit can be arranged not to interfere with a care giver or patient when the system is operated in the single mode.

In example embodiments, the control unit is operable to retract the strap element of the second motor unit in the single mode.

There may be provided a handheld controller coupled to the control unit, the controller including an input for switching between the dual and single modes.

A display unit may be associated with the first motor unit, the display being operative to indicate the operating mode of the system. In an illustrative embodiment, the display unit includes at least one input device for operating the system. The display unit may be menu based.

The strap element of the second motor unit may be manually withdrawn on a switch command from the single mode to the dual mode.

There may be provided at least one position sensor coupled to at least the strap element of the first motor unit, the position sensor being operable to sense at least one position of the strap element. There may also or in the alternative be provided at least one load sensor coupled to at least the strap element of the first motor unit, the load sensor being operable to sense load on the strap element.

In example embodiments, the control unit is incorporated in or associated with the first motor unit. In the embodiment, the first motor unit may be a leading or master unit and the second motor unit may be a driven or slave unit, the first and second motor units being communicatively connected to one another.

The apparatus may include a trolley element on which the first and second motor units are attached, the trolley element including wheel elements attachable to a ceiling rail system. The trolley element may include a first trolley member supporting the wheel elements and a second trolley member to which the first and second motor units are attached, the first and second trolley units being rotatable relative to one another. Advantageously, the first and second trolley units are coupled to one another by a rotatable coupler, the coupler including first and second concentric coupling rings with a cooperating rolling coupling therebetween, each coupling ring being attached to a respective one of the first and second trolley members.

According to another aspect of the present disclosure, there is provided a method of configuring a ceiling lift system, which system includes: first and second motor units; first and second flexible strap elements each coupled to a respective one of the first and second motor units, each motor unit being operable to change an operative length of its associated strap element by extending or retracting the strap out of or into the motor unit, each strap element including a coupling for attachment to a patient sling; a control unit coupled to the first and second motor units and configured to operate the motor units in a dual mode or a single mode; the method including the steps of: in the dual mode operating both the first and second the motor units together, and in the single mode operating the first motor unit and keeping the second motor unit in a non-operating condition; whereby in the dual mode attaching a double patient spreader bar assembly to the strap elements of the first and second motor units, and in the single mode attaching a single spreader bar to the strap element of the first motor unit.

According to another aspect of the present disclosure, there is provided a method of configuring a ceiling lift system. A method of configuring a ceiling lift system, which system includes: first and second motor units; first and second tensile support members operatively associated with a winding assembly to adjust an operative length of the tensile support members by extending or retracting the tensile support member, each tensile support member including a coupling for attachment to a patient sling; a control unit coupled to the first and second motor units and configured to operate the motor units in a dual mode or a single mode; the method including the steps of: in the dual mode operating both the first and second the motor units together, and in the single mode operating the first motor unit and keeping the second motor unit in a non-operating condition; whereby in the dual mode attaching a double patient spreader bar assembly to the tensile support members of the first and second motor units, and in the single mode attaching a single spreader bar to the tensile support member of the first motor unit.

The example method may include the step of disabling the second motor unit in the single mode. The method may also include the step of retracting the strap element of the second motor unit in the single mode. There may be included the step of manually withdrawing the strap element of the second motor unit on a switch from the single mode to the dual mode.

The example embodiment provides a ceiling lift assembly includes first and second motor units which can be operated together in a dual mode configuration and which can be operated in a single mode operation, in which only one of the motor units is operative with the other motor unit being dormant. The system provides routines for switching between the single and dual modes of the assembly and which ensure that in each mode the necessary parts of the apparatus are in an operative condition, whereas those parts of the apparatus which are not used are placed in a storage condition to avoid inconvenience or injury to personnel and patients. The apparatus also includes a motor unit support device of a structure which can accommodate asymmetric loads, on one motor unit only without causing deformation of the support structure.

Other features and aspects of the disclosure herein will become apparent from the disclosure of the example embodiments which follows.

BRIEF DESCRIPTION OF THE DRAWINGS

Embodiments of the present disclosure are described below, by way of example only, with reference to the accompanying drawings, in which.

DESCRIPTION OF THE ILLUSTRATIVE EMBODIMENTS

Figure 1:
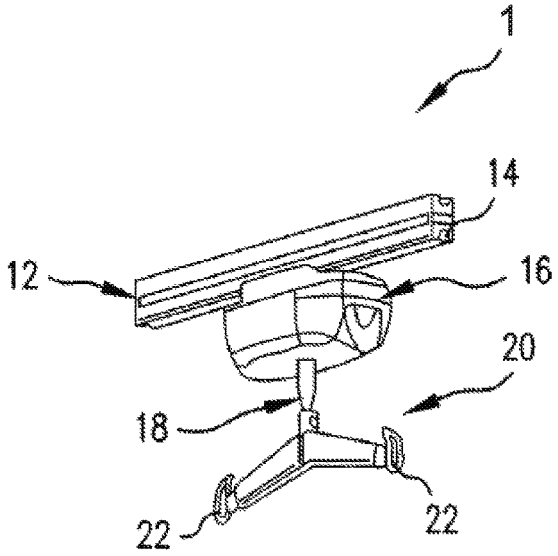
FIGS. 1 and 2 show an example of a prior art ceiling lift system, spreader bar and sling.

Referring first to FIG. 1, this shows a conventional ceiling lift system 1 which includes a rail 12 that is fixed to the ceiling structure of a patient care facility, such as a hospital, care home or the like. The rail 12 includes a downwardly depending channel 14. The system 1 may include a transmission, winding or coiling assembly, having for example a motor unit 16 which includes a wheel or roller (not shown) which runs within the downwardly depending channel 14 to allow the motor unit 16 to be moved in supported manner along the rail 12, as is known in the art.

Figure 2:
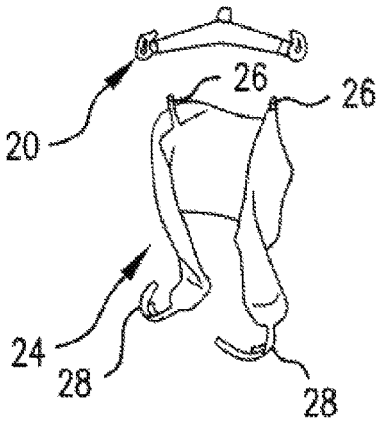

The motor unit 16 is operatively associated with, coupled to and/or includes a tensile support member, such as a flexible element or strap 18, which in practice is attached to a motorised spool or drum within the motor unit 16, and which can be unwound from the spool to lengthen the strap 18 and wound on the spool to shorten the strap 18, again in known manner. One skilled in the art would appreciate that one or more or any number of tensile support members may be operatively associated with, coupled to and/or form part of a motor unit to facilitate patient support. In one embodiment, the tensile support member is configured to be coilable about the drum or motorized spool of motor unit 16 and having sufficient tensile strength for lifting a patient. In an exemplary embodiment, the support member may be rigid in tension along its length yet permit motion in other directions to dynamically support a patient, inclusive of bariatric patients. Exemplary support members may include webbing, belts, rope, wire, cord, cable and chains. The strap 18 includes a coupler at its lower, free end, to which there can be attached a spreader bar 20, again of known form. The coupling can be any fastener, connector, attachment or securement mechanism suitable for connection to spreader bar 20. The spreader bar 20 includes coupling points 22, which are spaced from one another and specifically at either end of the bar 20. The coupling points 22 act as attachments for a sling 24, as shown in FIG. 2. The sling 24 is provided with a plurality of straps 26, 28, which attach to the coupling points 22 so that the sling 24 is held by the spreader bar 20 in an open condition to support a patient comfortably in the sling 24. These slings are well known in the art.

Figure 3:
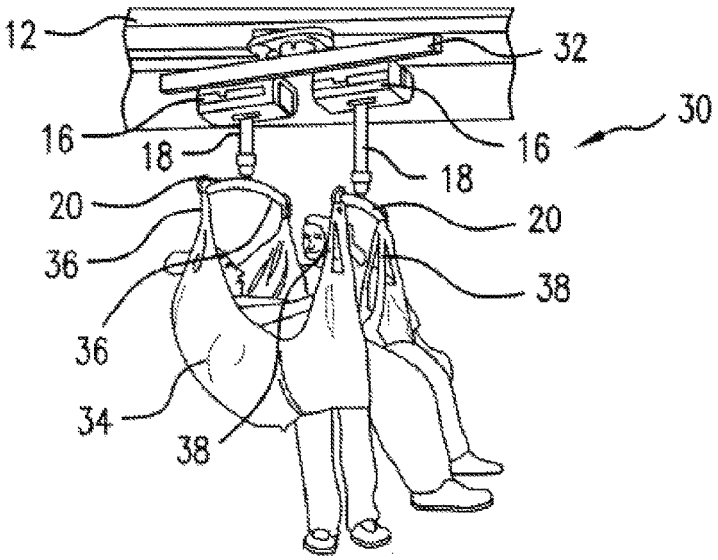
FIG. 3 shows an example of a double motor ceiling lift system.

While a system as shown in FIGS. 1 and 2 is suitable for lifting and transporting patients up to moderate sizes, heavier or larger patients cannot be carried by a simple system of this nature. In this regard, the apparatus of FIG. 3 is generally used. The apparatus 30 includes two motor units 16 which are attached to a support unit 32, is coupled to the rail 12, as in the example of FIG. 1. The apparatus 30 includes two spreader bars 20, each attached to a respective strap 18 of a respective motor unit 16. The motor units 16 are spaced from one another so that one strap 18 and its associated spreader bar 20 can be located around the top of the patient's torso, whereas the other motor unit and spreader bar 20 is located around the patient's thigh position. A sling 34 includes pairs of straps 36, 38 coupling to respective spreader bars 20, which allow a patient to be held within the sling 34 in a gently reclining position as shown in the example of FIG. 3.

The motor units 16 are operable to release and withdraw lengths of strap 18 such that the spreader bars 20 can be raised or lowered as required. For instance, the straps 18 can be lengthened to lower the spreader bars 20 towards a patient reclining on a bed and then wound into the motor units 16 to raise the spreader bars 20 and thus to raise the patient while carried in the sling 34. The motor units 16 are, for this purpose, controlled by a caregiver such as nurse, and are advantageously movable independently of one another so that the patient can be moved to different positions while suspended in the sling 34. For example, the patient can be held in a substantially reclining position as shown in FIG. 3 or could be raised to a sitting position, by raising the spreader bar 20 at the torso end of the patient. In an embodiment, the motor unit 16 could move to self-adapt to the patient position, for instance closer together in a seated position and further apart in reclined position. This does not occur with the embodiment shown.

As explained above, issues arise with seeking to handle patients of different size in a common system, useful for maximising the usage of a patient lift care facility.

Figure 4:
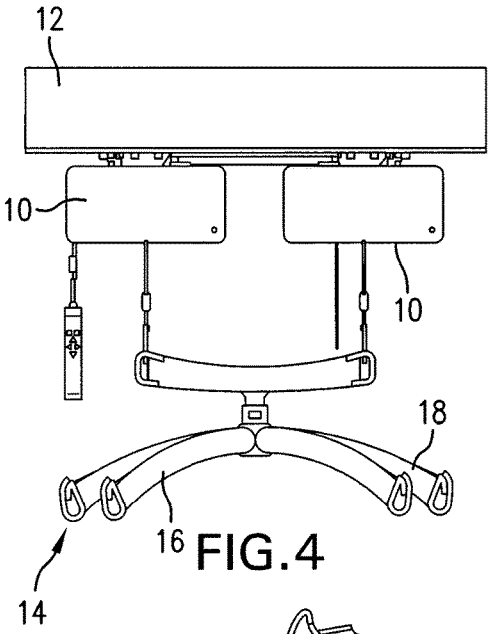
FIGS. 4 and 5 show an example of ceiling lift system with exchangeable spreader bars for different patient sizes.
Figure 5:
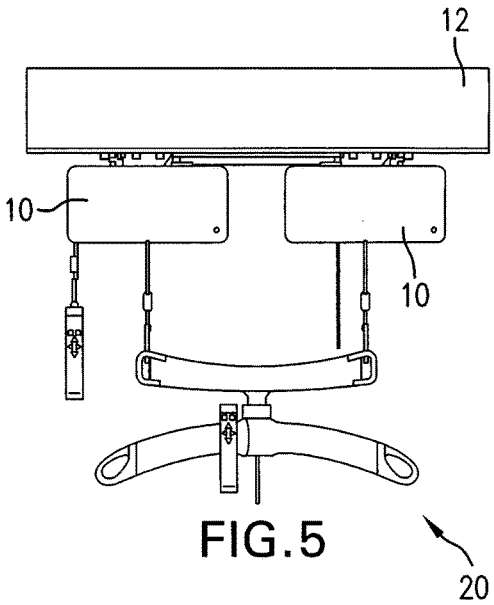

One solution which has been proposed is shown in FIGS. 4 and 5, which makes use of two motor units 10 attached to a rail system 12 and able to support the weight and size of a very large patient. This is a solution which has been used in the art.

In FIG. 4, a spreader bar 14 is shown, specifically designed for a large patient, and includes two pairs of spreader bar arms 16, 18 each having hooks for holding an associated strap of a patient sling. Such a structure using two motor units 10 provides greater lifting capacity but does not provide any tilting functionality.

In FIG. 5, the system has been reconfigured for a smaller patient, and in particular to have a single spreader bar 20 which is connected between the two motor units 10.

It is also known to use two independent spreader bars and two motor units to provide a tilt function, but these can present a limitation with regard to patients who are in the lower spectrum of patient size, in particular with precautions being necessary when using slings intended for smaller patients (both in height and body mass) in a spreader system intended or able to accommodate larger patients. This is especially true for patients who have lack of body tonus. The combination of a small sling and large spreader bar can create a large opening through which a patient can slide, particularly when using the tilting function and when left unattended. This is caused by the fact that the shoulder loops and legs loops of the sling are attached further away than when used with a smaller spreader bar. This can be seen in FIG. 6, in which a spreader bar arrangement 22 designed for larger patients is used with a sling 24 designed for a smaller patient, in which it can be seen that the straps 26 of the sling 24 are spread outwardly, leaving large gaps 30 through which the patient can fall. This can be contrasted with the arrangement of FIG. 7 in which a single spreader bar 32 can be used with a sling 34 for a smaller patient and which, being of appropriate dimensions, creates a more enclosed environment for holding the patient securely within the sling 34. However, using only one of the spreader bars on a ceiling lift system which has two motor units and normally two spreader bars operating together can create some inconvenience to the user, particularly as a result of the intrusiveness of the unused spreader bar or unused motor strap.

Figure 6:
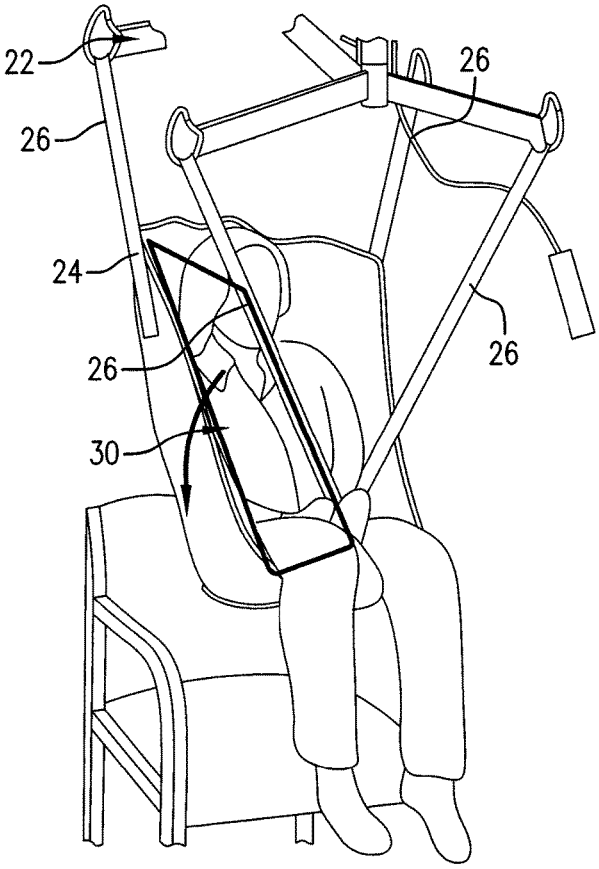
FIG. 6 shows an example of problem associated with using unsuitable slings in a patient lift system.
Figure 7:
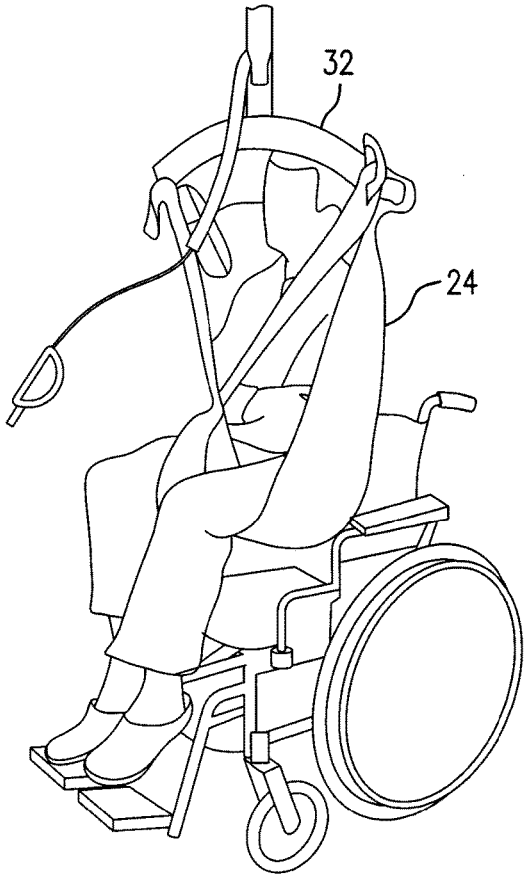
FIG. 7 shows a system suitable for lifting a small patient only.
Figure 8:
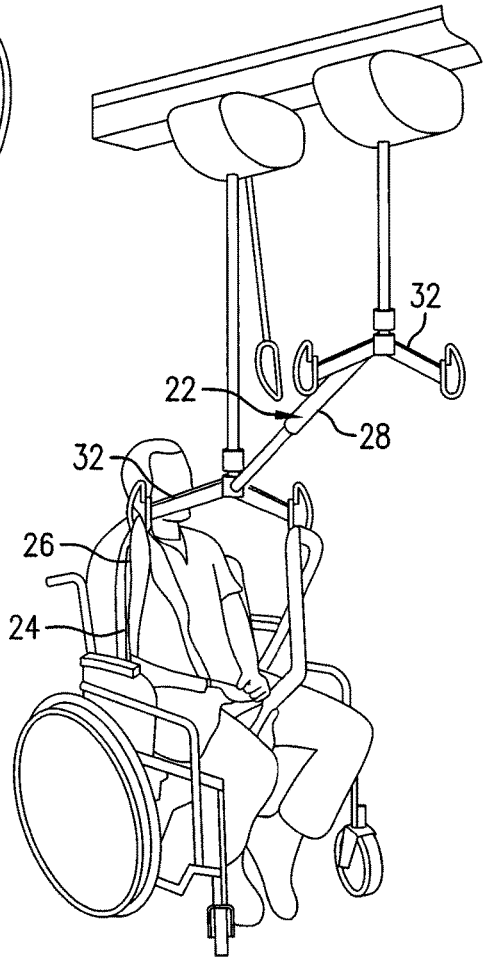
FIGS. 8 and 9 show an example of the problems associated with adapting a system for larger patients for use with smaller patients.
Figure 9:
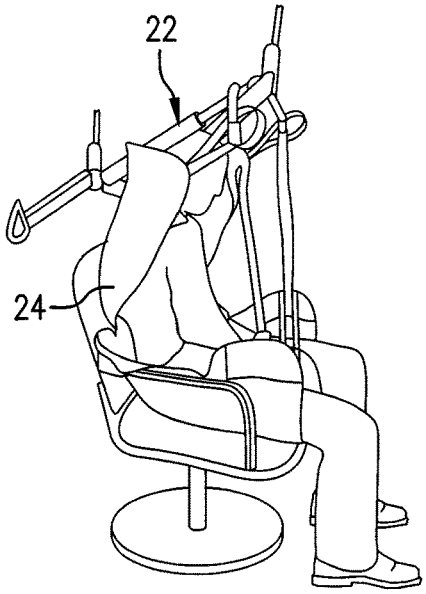

Examples are shown in FIGS. 8 and 9, in which the spreader bar 22 assembly of the example of FIG. 6 is shown being used with a sling 24 for a smaller framed patient and in which the straps 26 of the sling are connected to a single spreader bar yoke 32 of the spreader bar 22 to provide proper patient support within the sling 24. However, as can be seen in these Figures, the unused spreader bar yoke 32 is intrusive and can hit users or patients during the raising and transportation of the patient. In the example shown in FIGS. 8 and 9, the spreader bar yokes 32 are coupled together by a link 28, but even when the two spreader bar yokes 32 are separate from one another, there can still be problems with the unused yoke.

Figure 10:
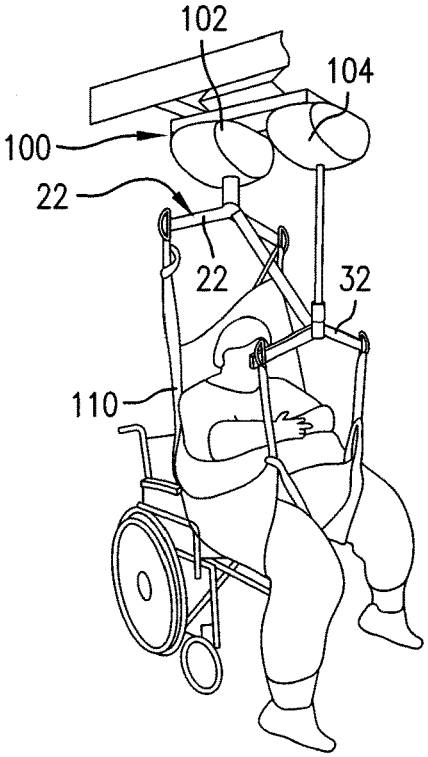
FIGS. 10 and 11 shows the operation of an illustrative embodiment of the present disclosure.
Figure 11:
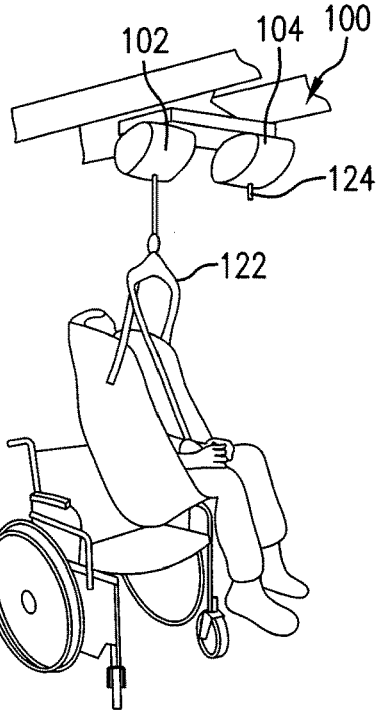

FIGS. 10 and 11 show a ceiling lift system 100 configured in accordance with an example embodiment of the present disclosure, which can be easily reconfigured between use with larger patients and with smaller patients. In FIG. 10 the system 100 is configured for use with a larger patient and has a spreader bar assembly 22 similar to that shown in FIG. 8 and supporting a sling 110 suitable for a larger patient, attached to each of the spreader bar yokes 32. The two motor units 102 of the system 100 can be operated independently to tilt a patient from a reclining to a sitting position, the sitting position being shown in FIG. 10. They can also be operated in coordinated manner to raise and lower a patient.

The same system 100 is shown in FIG. 11, though configured for a smaller patient, in which the spreader bar assembly 22 has been replaced with a single spreader bar yoke 122 attached to just one of the motor units 102, 104 of the assembly 100. As can be seen, the strap 124 of the second motor unit 104 has been retracted completely into the casing of the motor unit, so as to be completely out of the way of the patient and care giver. The mechanism and routine by which this is effected are disclosed in further detail below. In practice, what this provides is a ceiling lift system based on a double motor unit and double spreader bar assembly to be reconfigured by the user so as to operate in practice as a single motor unit with a single spreader bar. This makes the device readily compatible with an appropriate patient interface (spreader bar and sling) to transfer patients of a smaller size. In effect, what the arrangement provides is a system which can be configured for single mode and a dual mode in dependence on the patient to be lifted.

Figure 12:
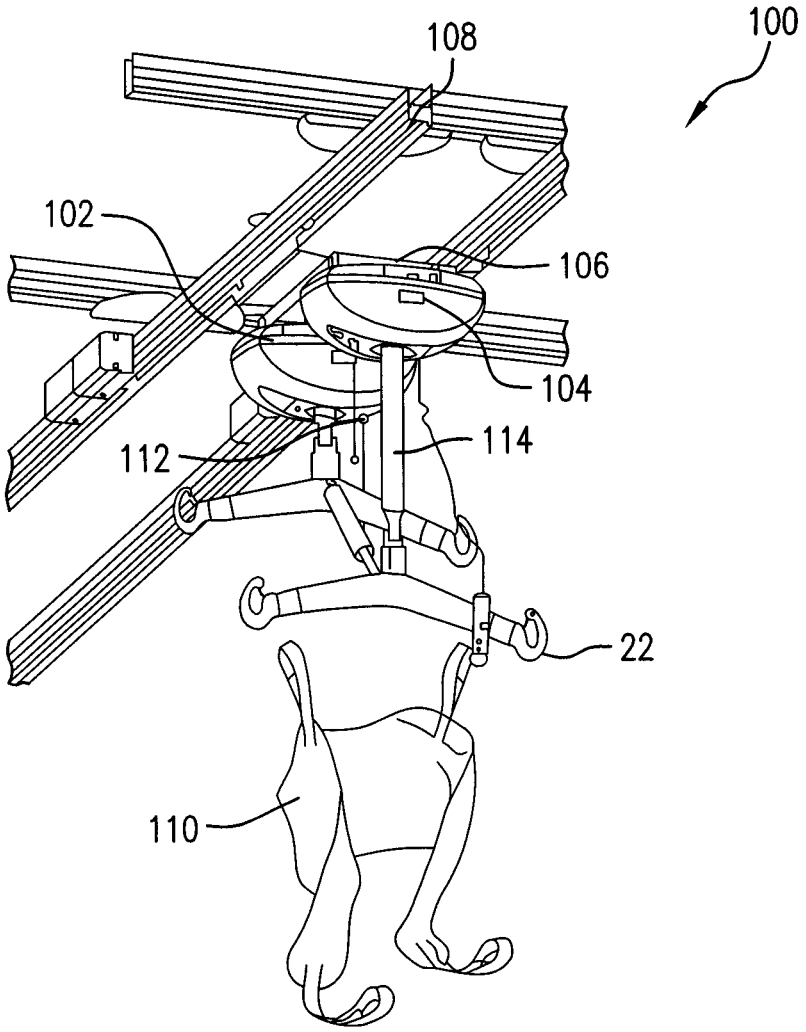
FIG. 12 is a schematic diagram of an example of apparatus suitable for an example embodiment of a configurable ceiling lift system.

The principal components of the system 100 are shown in FIG. 12, being the first and second motor units 102, 104, a trolley 106 to which the motor units are carried, the trolley 106 also attaching to rail system 108, as described in further detail below. Each of the first and second motor units 102, 104 has a strap element 102, 114, respectively, which is typically wound and unwound on a drum (not shown) within the motor unit in order to lengthen or shorten the operative length of strap extending from the motor unit. The motor units 102, 104 are in this embodiment separate devices with separate casings and components, linked electrically for coordinated control. It is not excluded, though, that the motor units 102, 104 could be incorporated into a common device with a common casing. In such cases, the motors of each motor unit remain both independently controllable and controllable in coordinated manner. In another embodiment, this could be achieved by one motor driving two drums and two straps.

A spreader bar assembly 22 is attached to the two straps 112, 114 for supporting a larger patient, with a sling 110 for attachment to the spreader bar assembly 22, in known manner.

Figure 13:
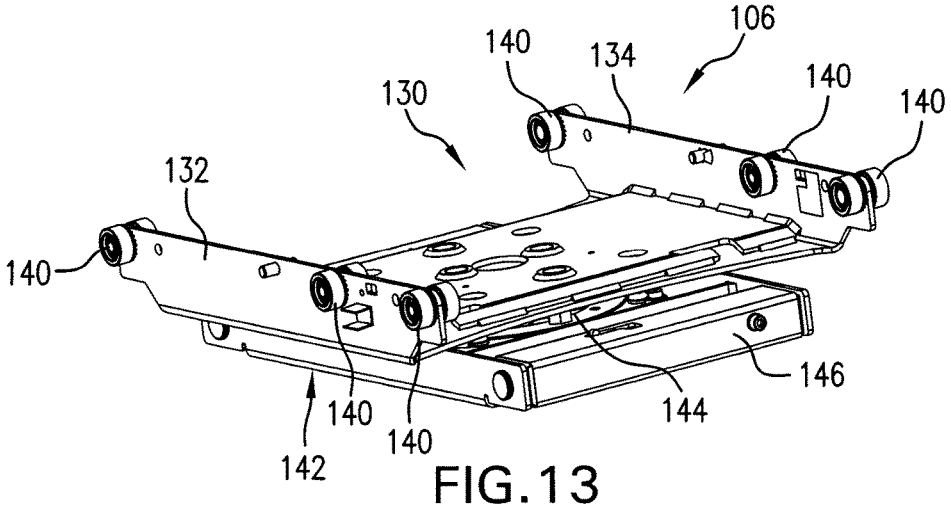
FIG. 13 is a perspective view of an example of motor carrier trolley for the system of FIG. 12.

Referring now to FIG. 13, this shows in better detail the trolley 106 to which the motor units 102, 104 are attached. The trolley unit 106 includes an upper frame element 130 which has two upwardly disposed side flanges 132 and 134, each of which is provided with a plurality of rollers 140 which in practice slide within associated channels of the rail system 108. The disposition, size and number of the rollers 140 is sufficient to support the weight of a large patient, which in an example embodiment may be a patient above 160 kilograms.

The trolley 106 also includes a lower frame member 142 which is attached to the upper frame member 130 by a rotatable coupling 144 of suitable form. Thus, the lower frame member 142 can rotate relative to the upper frame member 130. The lower frame member 142 includes a plurality of suitable attachment points 146 to which a motor unit 102, 104 can be attached. The trolley 106 thus couples the motor units 102, 104 to rail system 108 in a manner which allows the motor units to rotate horizontally, thereby to rotate a patient carried by the ceiling lift system.

Figure 14:
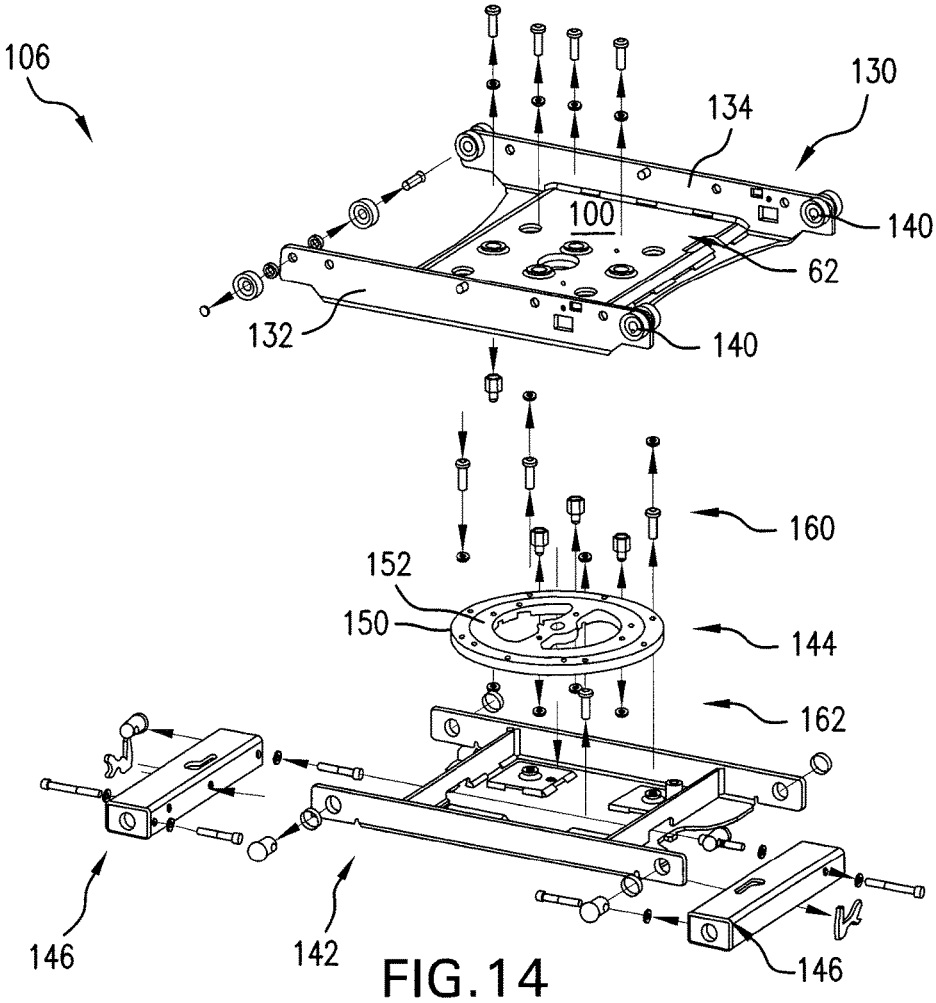
FIG. 14 is an exploded view of the trolley of FIG. 13.

Referring now to FIG. 14, this shows a view of the trolley assembly 106 of FIG. 13 in exploded form. Only the principal components of the assembly 106 are described herein, with minor components such as screws, bolts and the like shown in FIG. 14 not being described in detail, as such components are readily comprehendible by the person skilled in the art.

The rotary coupling element 144 includes inner and outer concentric rings 150, 152 which are able to rotate relative to one another, having a suitable rotational mechanism therebetween, which may for example be ball bearings disposed within annular channels (an internal channel in the ring 150 and an external channel in the ring 152).

Each ring 150, 152 comprises a plurality of holes therein, which may be threaded bores as appropriate, such that the rings 150, 152 can be fixed to a respective one of the upper and lower plates 130, 142 by suitable bolts. The use of a large diameter rotary connecting element 144 of this nature provides mechanical strength and stiffness to the trolley 106, enabling it to support asymmetrical loads on the trolley 106 which can occur, for example, during single mode use, that is when only one of the motor units 102, 104 is operated. In various embodiments, the trolley unit 106 will be configured to support very substantial loads, for example in excess of 270 kilograms.

The lower case in part 142 also includes upstanding walls and cross-members welded or otherwise fixed thereto, forming a chamber in which the rotary coupling member 144 can reside and which again provides mechanical strength and stiffness to the trolley unit 106. This structure can minimise or prevent deformation of the trolley 106 during asymmetrical loading and also during loading with very heavy patients.

The motor unit fixing elements 146 are, in this embodiment, box sections, again for strength and rigidity.

The trolley 106 has a large footprint, which provides for spread of the load and reduction in deflection forces. It has been found that trolleys having a design of this nature may deflect at their furthest point by a maximum of 5-10 mm under an asymmetrical load of 160 kilograms on one of the motor units and 0 kilograms on the other unit. This enables operating push/pull forces to be below 156 Newtons measured at the end of a spreader bar when rotating a patient supported in the assembly.

The trolley unit 106 can be made of any suitable material, including iron, steel, aluminum and so on.

Figure 15:
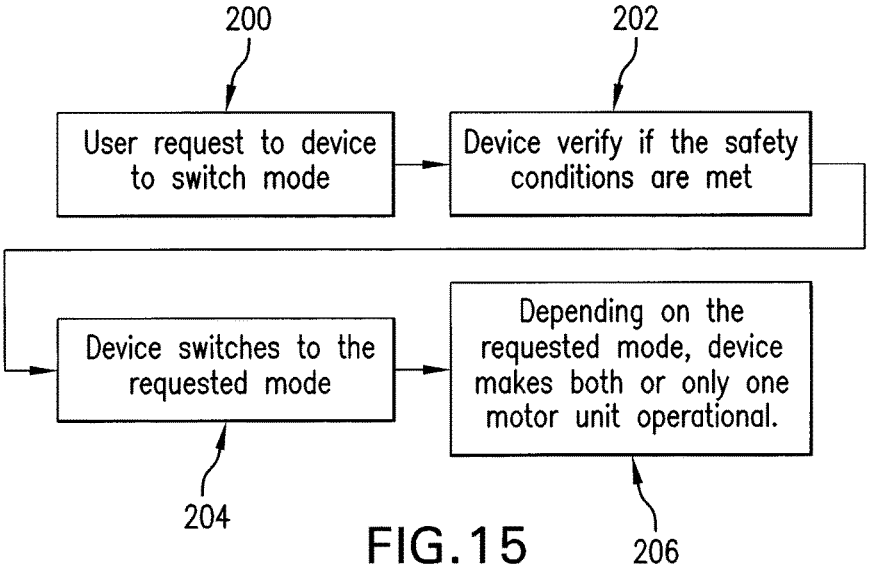
FIG. 15 is a conceptual flow chart of the operation of an example embodiment of a configurable system.

Referring now to FIG. 15, this shows in basic form the concept of using the patient lift assembly 100 in dual or single modes and the sequence of reconfiguring between these modes of operation. The system 100 itself, as will be apparent from the above, provides two motor units to which can be attached to two spreader bars and in example embodiments has one motor unit which is designated the leading or master motor unit and the other is operated as a driven or slave motor unit. The leading motor unit governs the actions of the driven motor unit and is the one to which a user hand controller can be connected. Thus, the leading motor unit receives input from the user and provides output to the user. One of the inputs which can be provided to the user is a mode switch, by which the user can designate the device to operate in single or dual mode. Turning to FIG. 15, therefore, at step 200 the user can request, via appropriate preparation of a handheld unit, described in further detail below, a particular mode of operation of the ceiling lift apparatus 100. At step 202, the system verifies that the apparatus 100 is in a safe condition in order to switch between modes. If safe operation is verified, at step 204 the apparatus 100 switches to the requested mode, single motor use or dual motor use, and in step 206, depending upon the mode requested in step 200, the apparatus, via the leading motor unit, makes one or both of the motor units operational. The apparatus, as will be apparent below, may include a display device for indicating the mode of operation to which the apparatus 100 has been set.

There are a number of safety conditions which can be verified at step 202. A first condition involves detect, via a suitable load sensor provided in the motor units 102 and 104, that a mass exceeding 12 kilograms is suspended on any of the straps 112 and 114 (via any spreader bar attached thereto) when a request for reconfiguration is made. If such a load has been exceeded, the process is aborted and as a result steps 204 and 206 are not carried out.

Another condition applies during the reconfiguration process when, for instance, an automated motion of winding one of the straps 112, 114 into its respective motor unit is due to occur and the system 1010, via the leading motor unit, detects if: a) the lifted weight increases rapidly (for instance an increase of 3 kilograms in half a second or so) or b) the maximum lifted weight reaches or exceeds a value of around 12 kilograms. Again, the mode switch process is aborted in these circumstances.

It will be appreciated that for these purposes the driven control unit 102 will be provided with processing circuitry, typically including a microprocessor, suitable memory, load sensor and/or position sensor connected to the straps, an input/output interface and other conventional components.

The operation of the unit 100 is depicted in the sequence of steps shown in FIGS. 16-19. Referring first to FIGS. 16A to 16C, these show the reconfiguration of the system 100 from a dual mode to single mode using the hand controller 160 shown in the drawing and which is connected to the driven motor unit 102. The driven motor unit 102 is coupled electrically to the leading motor unit 104, for example by a suitable cable.

The apparatus 100, in the dual mode, would normally have attached thereto a two-strap spreader bar assembly 22 of the type previously described. In operation, in the first stage, a raise or lift button 162 on the hand-held device 160 is pressed for a period, typically at least two seconds, to cause the assembly 100 to raise the spreader bar assembly 22 to a convenient height. It is during this lifting period that the safety condition of the support load is checked.

The spreader bar assembly 22 is then detached from the straps 112, 114 and can be stored in a suitable clip 164 located on a patient cart, support wall or the like.

Figure 16A:
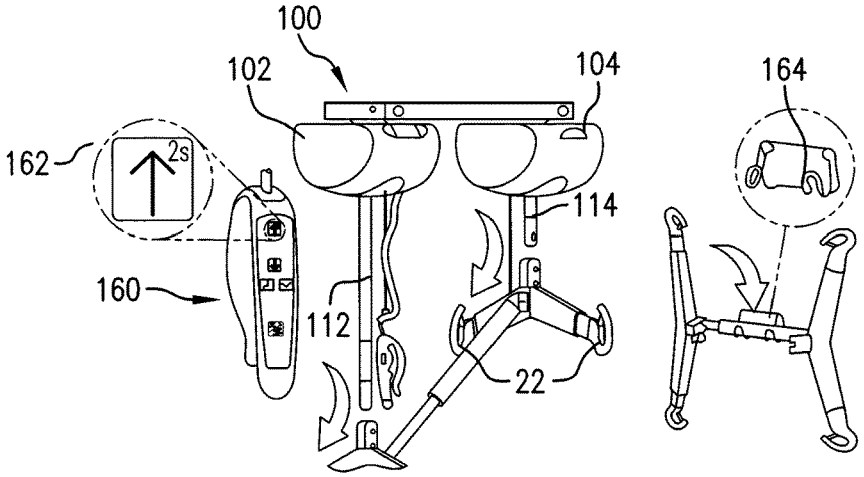
FIGS. 16A to 16C depicts how the apparatus can be reconfigured from dual mode to single mode use using a hand controller.
Figure 16B:
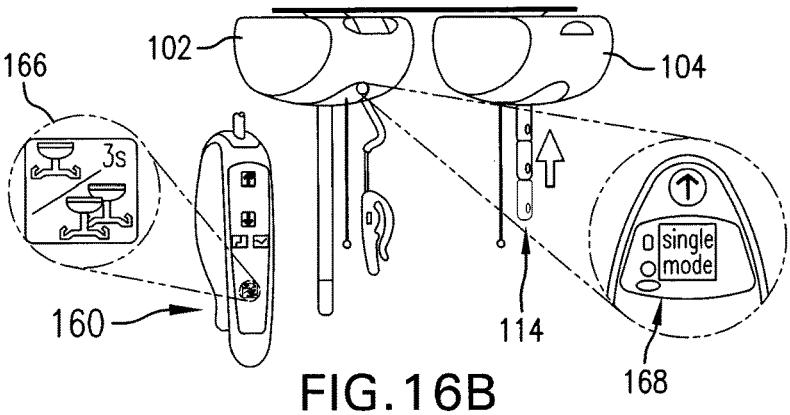

Once the spreader bar 22 has been removed, as shown in FIG. 16B, the mode switch button 166 of the hand-held unit 160 can be pressed, such as for a minimum period of, for example, 3 seconds or so, to cause the assembly 100 to enter the mode reconfiguration routine. In this mode the driven motor unit 102 controls the leading motor unit 104 to retract its strap 114 into the motor unit 104, by winding on the drum within the motor unit 104. The strap 114 as a result is moved out of use and out of the way of the patient and any care giver. In an example embodiment, at the end of the reconfiguration process, the leading motor unit, via display 168, indicates that the apparatus 100 is set in the single mode configuration. At the same time, the leading unit 104 enters a sleep mode such that any further control activation commanded through the handset 106 will operate only the driven motor unit 102, such that the apparatus 100 operates as a single motor device. The second motor unit 104 is dormant.

Figure 16C:
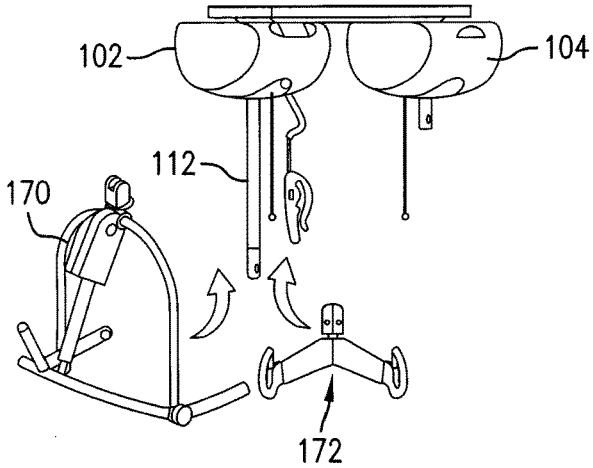

Finally, as shown in FIG. 16C, a suitable spreader bar assembly 170, 172 can be attached to the strap 112 of the driven motor unit 102, for coupling a suitable sling for a smaller patient to the system 100.

Referring now to FIGS. 17A to 17D, another embodiment for switching from the dual mode to the single mode is illustrated. In this embodiment the change in configuration is effected via inputs of the display unit 168 of the driven motor unit 102. The skilled person will appreciate that in some or all embodiments the apparatus 100 could have the both the functionalities of the handset 160 and the display monitor 168, such that it could be operated by either of these; whereas in other embodiments a single control input device may be provided, either the handheld unit or the functionality of the display 168.

Figure 17A:
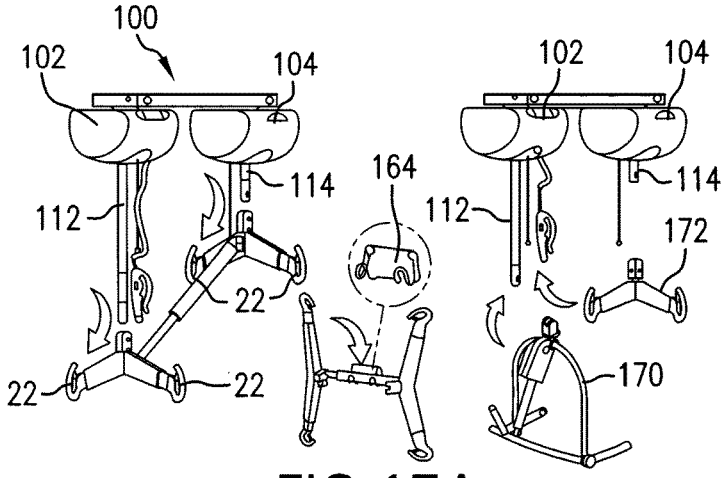
FIGS. 17A to 17D depict how the apparatus can be reconfigured from dual mode to single mode use using a motor unit display and menu.

Referring to the detail of FIG. 17A, the spreader bar assembly 22 is initially detached from the straps 112, 114 and suitably stored, advantageously on storage hook 164 which may be fixed to a part of the apparatus. If necessary, the spreader bar assembly 22 could be raised or lowered to a suitable height before being removed.

Figure 17B:
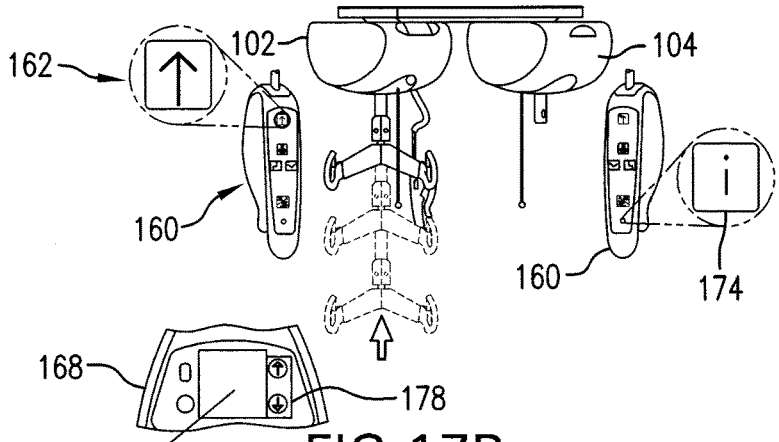
Figure 17C:
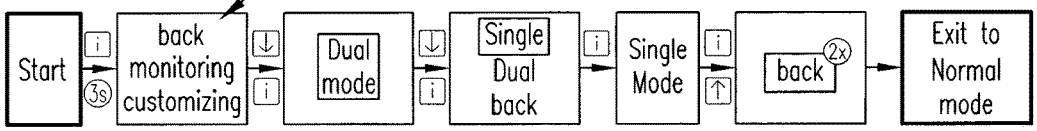

Next, as shown in FIG. 17B, a compatible single spreader bar 170, 172 is attached to the strap 112 of the driven motor unit 102. Once attached, the lift or up button 162 of the handheld controller 160 is pressed until both straps 112, 114 are fully retracted to their highest limit. Once this position is reached, a control button (i.e., in the present example, the "i" button 174 of the handset 160) is pressed, such as for a specified period such as for 3 seconds, in order to cause the display unit 168 to enter into its customising menu mode. In this mode, the display unit 168 provides a series of menus 176, as shown in FIG. 17C, which can be accessed by input buttons 178 on the display unit 168. These menus enable the user to switch between the modes of the apparatus 100, in this example from a dual mode, in which both motor units 102, 104 are operable, to a single mode, in which only the driven motor unit 102 is operable.

Figure 17D:
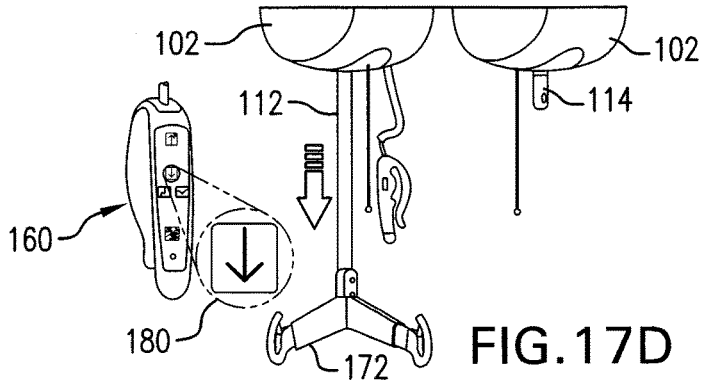

Once the single mode has been selected, the system can exit to the normal mode of operation, in which any further control by the handset 160 will cause only the driven motor 102 to operate, with the leading motor 104 being at rest, or prevented, from operating. As can be seen in FIG. 17D, when in this mode, depression of the down arrow key 180 will cause the driven motor unit 102 to unwind its associated strap 112 to lower the spreader bar 172. The leading motor unit 104 remains non-operational in this mode.

Figure 18A:
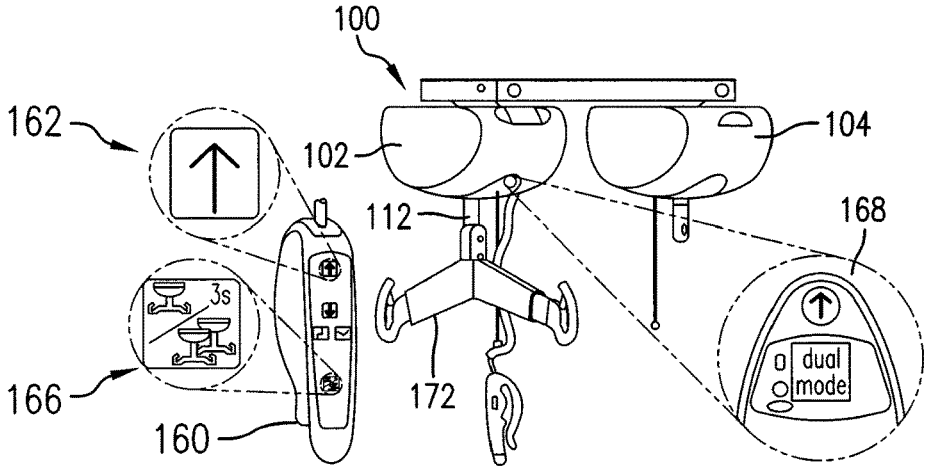
FIGS. 18A to 18C depict how the apparatus can be reconfigured from single mode to dual mode use using a hand controller.
Figure 18B:
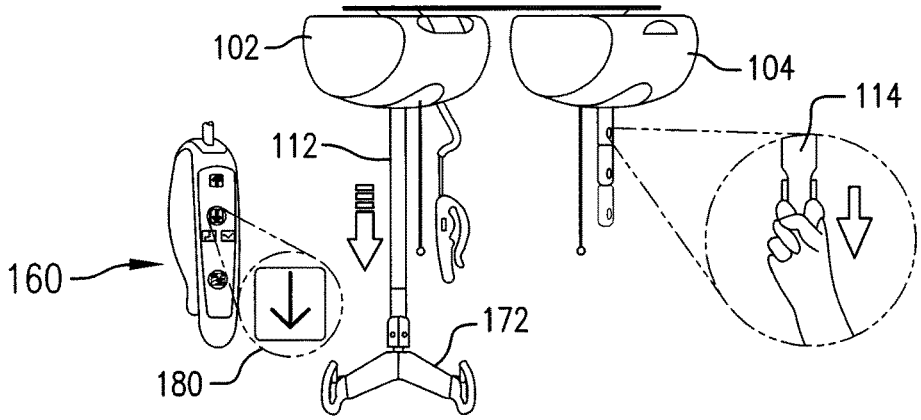
Figure 18C:
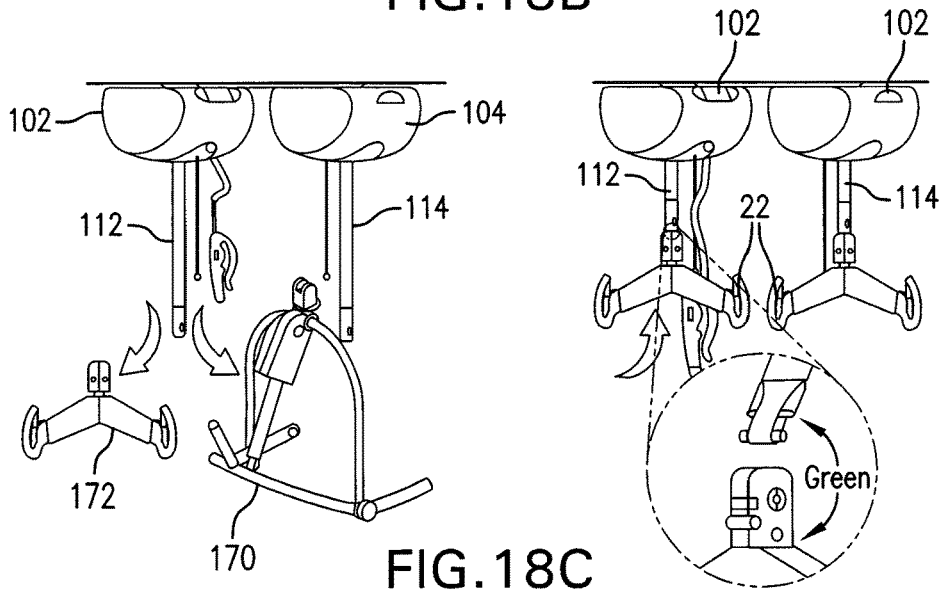

FIGS. 18 and 19 show how the system 100 can switch from the single mode to the dual mode. Referring first to FIGS. 18A to 18C, these show the switch from the single mode to the dual mode using the hand controller 160.

In the first instance, as shown in FIG. 18A, the up arrow button 162 of the hand controller 160 is pressed to bring the strap 112 of the driven motor 102 and as a result the spreader bar 172 to its highest limit. The motor 104 is, at this stage, inactive and its strap 114 is already at its most wound or highest position. Once at the highest limit, the user presses and holds the mode selector button 166, such as for a specified period such as 3 seconds, which will switch the system into dual mode and this will be displayed on the display unit 168.

Next, as shown in FIG. 18B, the lowering or down arrow key 180 of the keypad 160 is pressed to cause the driven motor unit 102 to unwind the associated strap 112 and with it the single spreader bar 172. The leading motor unit 104 may remain idle but unlocked, so that the associated strap 114 is manually pulled down by the user, until it is at or around the same height as the driven strap 112. In the other embodiments, though, the strap 114 could be lowered simultaneously with the strap 112 or otherwise automatically by operation of the leading motor 104.

Once lowered sufficiently, as shown in FIG. 18C, the spreader bar 172 (or the spreader bar 170 if used instead) is removed from the strap 112 and the dual mode spreader bar 22 is then attached to the two straps 112 and 114. The system 100 can then be operated in the dual mode with the spreader bar assembly 22 kept horizontal to support a patient in the lying position, or tilted to raise the patient into a seating position, as desired and appropriate.

With reference now to FIGS. 19A to 19D, shown is the switch from the single mode to the dual mode, using the motor unit display 168 to control the mode change. The same functionality as depicted in FIGS. 17A to 17D is used.

Figure 19A:
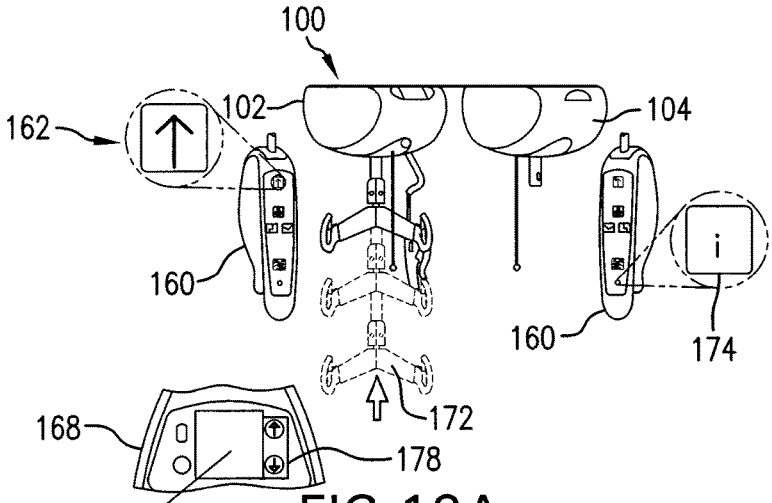
FIGS. 19A to 19D depict how the apparatus can be reconfigured from single mode to dual mode use using a motor unit display and menu.
Figure 19B:
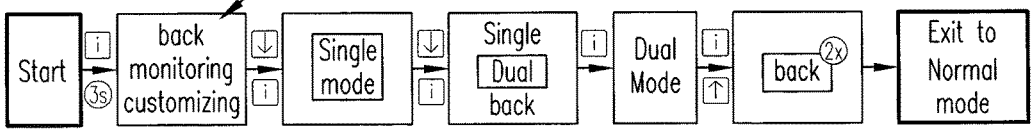

In the first instance, as shown in FIG. 19A, the user presses the raise or up arrow button 162 of the hand controller 160 to raise the spreader bar 172 to its highest position. The strap 114 of the leading motor unit 104 is already in its uppermost position and the motor unit 104 is in a dormant or rest state. Once the strap 112 has been fully retracted into the driven motor unit 102, the control button, shown as the "i" button 174, is pressed to activate the motor unit display, such as for a defined period such as 3 seconds or so. Once this occurs, the display unit 176 enters its menu mode 176, depicted in FIG. 19B, enabling control via the buttons 178 of the display unit 168. The user can move through the menus in order to switch from the single mode to the dual mode as shown.

Figure 19C:
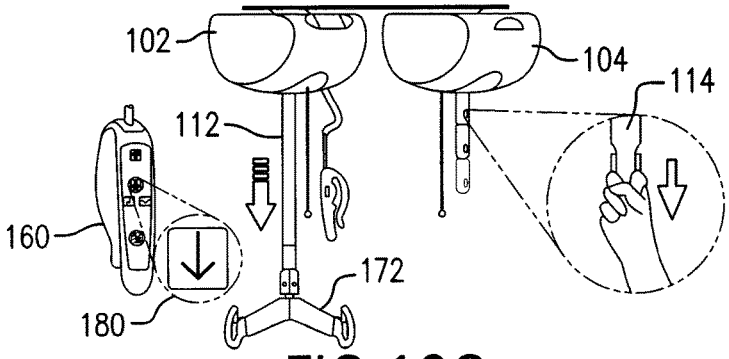

Once the dual mode has been activated, as shown in FIG. 19C, the user then presses the lower or down arrow button 180 in the handheld controller 160 in order to unwind the strap 112 from the motor unit 102 and lower the spreader bar 172 to a suitable height. The strap 114 of the leading motor unit 104 can be manually pulled down by the user, although this may be done automatically as described above in connection with the routine of FIG. 18.

Figure 19D:
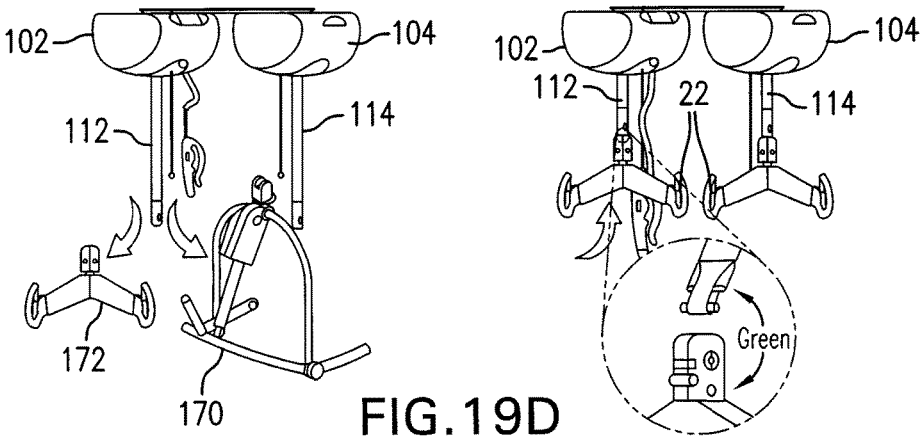

Once the strap 112 has been lowered sufficiently, as shown in FIG. 19D, the single mode spreader bar 172 (or 170 if that has been used) is detached from the strap 112 and the dual mode spreader bar assembly can then be attached to the straps 112 and 114, thereby enabling use of the apparatus 100 in the dual mode. As described above, in a dual mode the motor units 102, 104 can be operated to support a patient in a lying position or a sitting position as desired and appropriate.

Thus, the system disclosed herein provides a ceiling lift assembly which can be used both in the dual mode and in a single mode, useful for lifting patients of a large range of sizes and weights, which does not inconvenience or put at risk the user or patient, and which is also able to support a patient's weight without undue deformation of any components of the assembly caused by the patient load.

Although the embodiment described uses two separate motor units, it is to be understood that the motor units could be incorporated into the same casing and could also comprise a common motor, that is having two drums driven by the same motor through suitable transmissions. There may also be provided more than two motor units, for instance three or more motor units to have three or more straps, where all three can be used in a combined mode, some can be operated together and the other or others separately, and also in single mode where only one is operated.

All optional and preferred features and modifications of the described embodiments and dependent claims are usable in all aspects of the illustrative embodiments taught herein. Furthermore, the individual features of the dependent claims, as well as all optional and preferred features and modifications of the described embodiments are combinable and interchangeable with one another.

While systems and methods have been described with reference to certain embodiments within this disclosure, one of ordinary skill in the art will recognize that additions, deletions, substitutions and improvements can be made while remaining within the scope and spirit of the invention as defined by the appended claims.

The disclosure in the abstract accompanying this application is incorporated herein by reference.

We claim:

1. A configurable patient ceiling lift system, comprising:

first and second motor units;

first and second tensile support members operatively associated with a winding assembly to adjust an operative length of the first and second tensile support members by extending or retracting the first and second tensile support members, each of the first and second tensile support members including a coupling for attachment to a patient sling;

a control unit coupled to the first and second motor units and configured to operate the first and second motor units in a dual mode or a single mode, wherein in the dual mode the first and second motor units are both operable and in the single mode the first motor unit is operable and the second motor unit does not operate, and a trolley element on which the first and second motor units are attached, the trolley element including wheel elements attachable to a ceiling rail system, wherein the trolley element includes a first trolley member supporting the wheel elements and a second trolley member to which the first and second motor units are attached, the first and second trolley members being rotatable relative to one another, and wherein the first and second trolley units are coupled to one another by a rotatable coupler, the coupler including first and second concentric coupling rings with a cooperating rolling coupling therebetween, each coupling ring being attached to a respective one of the first and second trolley members.

2. The configurable ceiling lift system according to claim 1, wherein the second motor unit is disabled in the single mode.

3. The configurable ceiling lift system according to claim 1, wherein the control unit is operable to retract one of the first and second tensile support members in the single mode using the winding assembly.

4. The configurable ceiling lift system according to claim 1, further comprising a handheld controller coupled to the control unit, the controller including an input for switching between the dual and single modes.

5. The configurable ceiling lift system according to claim 1, further comprising a display unit associated with the first motor unit, the display being operative to indicate the operating mode of the system, and wherein the display unit includes at least one input device for operating the system.

6. The configurable ceiling lift system according to claim 1, further comprising at least one position sensor coupled to at least the first tensile support member of the first motor unit, the position sensor being operable to sense at least one position of the first tensile support member.

7. The configurable ceiling lift system according to claim 1, further comprising at least one load sensor coupled to at least the first tensile support member of the first motor unit, the at least one load sensor being operable to sense load on the first tensile support member of the first motor unit.

8. The configurable ceiling lift system according to claim 1, wherein the control unit is incorporated in or associated with the first motor unit.

9. The configurable ceiling lift system according to claim 1, wherein the first motor unit is a master unit and the second motor unit is a slave unit, the first and second motor units being communicatively connected to one another.

10. A method of configuring a ceiling lift system, which system includes:

first and second motor units;

first and second tensile support members operatively associated with a winding assembly to adjust an operative length of the first and second tensile support members by extending or retracting the first and second tensile support members, each of the first and second tensile support members including a coupling for attachment to a patient sling;

a control unit coupled to the first and second motor units and configured to operate the first and second motor units in a dual mode or a single mode; and a trolley element on which the first and second motor units are attached, the trolley element including wheel elements attachable to a ceiling rail system, wherein the trolley element includes a first trolley member supporting the wheel elements and a second trolley member to which the first and second motor units are attached, the first and second trolley members being rotatable relative to one another, and wherein the first and second trolley units are coupled to one another by a rotatable coupler, the coupler including first and second concentric coupling rings with a cooperating rolling coupling therebetween, each coupling ring being attached to a respective one of the first and second trolley members, the method including the steps of:

operating both the first and second motor units together in the dual mode, and operating the first motor unit and keeping the second motor unit in a non-operating condition in the single mode; whereby attaching a double patient spreader bar assembly to the first and second tensile support members of the first and second motor units in the dual mode, and attaching a single spreader bar to the first tensile support member of the first motor unit in the single mode.

11. The method according to claim 10, further comprising the step of disabling the second motor unit in the single mode.

12. The method according to claim 10, further comprising the step of retracting the tensile support member of the second motor unit in the single mode.

13. The system according to claim 1, wherein at least one of the first and second tensile support members comprises a strap.

14. The system according to claim 1, wherein at least one of the first and second tensile support members comprises a webbing, belt, rope, wire, cord, cable and/or chains.

15. The system according to claim 1, wherein at least one of the first and second tensile support members is substantially rigid when placed in tension along its length and movable in other directions to dynamically support a patient.

16. The system according to claim 1, wherein the winding assembly comprises the first motor unit, wherein the first tensile support member is coupled to the first motor unit.

17. The system according to claim 16, wherein the winding assembly further comprises the second motor unit, wherein the second tensile support member is coupled to the second motor unit.

* * * * *